US007690370B2

(12) United States Patent
Mino et al.

(10) Patent No.: US 7,690,370 B2
(45) Date of Patent: Apr. 6, 2010

(54) FUEL INJECTION CONTROLLER FOR INTERNAL COMBUSTION ENGINE

(75) Inventors: Ryota Mino, Aichi-ken (JP); Hirohiko Yamada, Okazaki (JP); Hideki Teshima, Aichi-ken (JP); Hidetoshi Tsutsumi, Chiryu (JP)

(73) Assignees: Toyota Jidosha Kabushiki Kaisha, Toyota-shi (JP); Denso Corporation, Kariya-shi (JP); Aisan Kogyo Kabushiki Kaisha, Obu-shi (JP)

( * ) Notice: Subject to any disclaimer, the term of this patent is extended or adjusted under 35 U.S.C. 154(b) by 97 days.

(21) Appl. No.: 12/139,043

(22) Filed: Jun. 13, 2008

(65) Prior Publication Data

US 2008/0312808 A1 Dec. 18, 2008

(30) Foreign Application Priority Data

Jun. 15, 2007 (JP) ..... 2007-159017

(51) Int. Cl.
*F02D 41/04* (2006.01)
*F02M 33/04* (2006.01)

(52) U.S. Cl. ..... 123/698; 123/516; 123/518; 123/520

(58) Field of Classification Search ..... 123/516, 123/518, 519, 520, 698
See application file for complete search history.

(56) References Cited

U.S. PATENT DOCUMENTS 5,626,122 A * 5/1997 Azuma ..... 123/685
5,685,285 A * 11/1997 Ohtani et al. ..... 123/698
5,746,187 A * 5/1998 Ninomiya et al. ..... 123/520
6,523,531 B1 * 2/2003 Feldkamp et al. ..... 123/698
6,880,541 B2 * 4/2005 Hanazaki et al. ..... 123/698
7,171,960 B1 * 2/2007 Hagari ..... 123/698
2007/0277789 A1 * 12/2007 Ishikawa et al. ..... 123/520

FOREIGN PATENT DOCUMENTS

JP 2003-120379 4/2003
JP 3582137 8/2004

* cited by examiner

*Primary Examiner*—Erick Solis
(74) *Attorney, Agent, or Firm*—Oblon, Spivak, McClelland, Maier & Neustadt, L.L.P.

(57) ABSTRACT

A fuel injection controller for an internal combustion engine. The engine includes a fuel vapor treatment device having a collector for collecting fuel vapor generating in a fuel tank; a purge line that introduces purge gas into an intake passage of the engine, the purge gas being a mixture of fuel vapor released from the collector and air; and a purge valve provided in the purge line to adjust flow rate of the purge gas. The fuel injection controller corrects an amount of fuel injected from an fuel injection valve based on an amount of fuel vapor contained in the purge gas flowing into a combustion chamber of the engine. The fuel injection controller comprises an estimation section for estimating the inflow amount of the purge gas flowing into the combustion chamber based on a passed amount of purge gas that has passed through the purge valve and a compensation value for compensating transportation delay. The compensation value is set based on internal pressure of the intake passage and velocity of intake air that flows into the combustion chamber.

6 Claims, 4 Drawing Sheets

FUEL INJECTION CONTROLLER FOR INTERNAL COMBUSTION ENGINE

CROSS-REFERENCE TO RELATED APPLICATION

This application is based upon and claims the benefit of priority from prior Japanese Patent Application No. 2007-159017, filed on Jun. 15, 2008, the entire content of which is incorporated herein by reference.

FIELD OF THE INVENTION

The present invention relates to a fuel injection controller for an internal combustion engine.

BACKGROUND

In an internal combustion engine for vehicles, fuel vapor treatment device for collecting the fuel vapor generating in the fuel tank is provided to prevent the fuel vapor from being released to the atmosphere. The fuel vapor treatment device includes a collector (or a canister) for collecting fuel vapor generating in the fuel tank; a purge line that introduces purge gas into an intake passage of the engine, the purge gas being a mixture of fuel vapor released from the collector and air; and a purge valve provided in the purge line to adjust flow rate of the purge gas.

Because of a limitation of the amount of fuel vapor collected, "purging process" is performed. In the purging process, the purge valve is opened to release fuel vapor from the collector, and then purge gas, i.e., a mixture of the fuel vapor and air, is introduced into an intake passage via the purge line to combust the purge gas in a combustion chamber while the engine operates. By performing such a purging process, the performance of collecting fuel vapor by the collector is recovered.

When the purging process is performed, in addition to the fuel injected from the fuel injection valve, fuel vapor contained in the purge gas is also introduced in the combustion chamber of the engine. Thus, in the fuel injection control during the purging process, fuel injection amount is reduced depending on the amount of the fuel vapor contained in the purge gas thereby reducing or preventing the fluctuation in the air-fuel ratio.

After the purging process starts, it takes some time for the amount of purge gas corresponding to the opening degree of the purge valve to flow into the combustion chamber. More specifically, as illustrated in FIG. 4, when the purge valve is opened at time t1, purge gas that has passed through the purge valve starts flowing into the combustion chamber at time t2 after some degree of delay time. Then, the inflow amount of purge gas flowing into the combustion chamber is gradually changed at a certain degree of change. After some degree of response period goes by, purge gas starts flowing into the combustion chamber in an amount corresponding to the opening degree of the purge valve, at time t3.

As described above, there are delay time and transportation delay of purge gas depending on the degree of change. Thus, in order to reduce the fuel injection amount depending on the amount of the fuel vapor contained in the purge gas, such transportation delay of purge gas must be taken into consideration. Although FIG. 4 illustrates an example when the amount of purge gas is increased after the opening of the purge valve, the transportation delay also occurs when the amount of purge gas is decreased after the closing of the purge valve.

To address this, for example, in an apparatus described in Japanese Patent No. 3582137, the amount of purge gas that flows into the combustion chamber is estimated based on the passed amount of purge gas that has passed through the purge valve and a formula that models the transportation delay. Also, since the velocity of intake air flowing into the combustion chamber becomes greater as the engine rotation speed is higher, the time of the transportation delay is likely to become shorter. Thus, in the case when the transportation delay is estimated by the formula, by setting a compensation value for compensating the transportation delay (i.e., a value for estimating the amount of purge gas flowing into the combustion chamber based on the passed amount of purge gas that has passed through the purge valve) based on the engine rotation speed, the amount of purge gas flowing into the combustion chamber can be estimated.

Generally, as the engine rotation speed becomes higher, internal pressure of the intake passage and velocity of intake air flowing into the combustion chamber become greater. In this way, when the increase in the internal pressure and the increase in the velocity of intake air are correlated, i.e., when the internal pressure and the velocity of intake air are positively correlated, the compensation value of purge gas for compensating the transportation delay can be set based on the engine rotation speed.

However, in an internal combustion engine including a variable lift device for changing a maximum lift of the air intake valve 19 and in an internal combustion engine including an exhaust gas recirculation mechanism into the intake passage, it sometimes happens that the internal pressure and the velocity of intake air are not positively correlated. It has been revealed that the setting of the compensation value for compensating the transportation delay based on the engine rotation speed cannot be made accurately in such engines.

When the compensation value of purge gas cannot be set accurately, the amount of purge gas flowing into the combustion chamber cannot be estimated, either. This makes it impossible to accurately estimate the amount of fuel vapor in the purge gas flowing into the combustion chamber and ultimately to accurately reduce the fuel injection amount during the period when purging process is performed, either.

Accordingly, there is room for improvement in estimating accurately the amount of purge gas flowing into the combustion chamber in which the internal pressure and the velocity of intake air are not positively correlated.

SUMMARY OF THE INVENTION

An object of the invention is to provide a fuel injection controller for an internal combustion engine in which the compensation value of purge gas can be set accurately so that the amount of purge gas flowing into the combustion chamber is estimated accurately even in the engine in which the internal pressure and the velocity of intake air are not positively correlated.

According to an aspect of the invention, a fuel injection controller for an internal combustion engine is provided. The engine includes a fuel vapor treatment device having a collector for collecting fuel vapor generating in a fuel tank; a purge line that introduces purge gas into an intake passage of the engine, the purge gas being a mixture of fuel vapor released from the collector and air; and a purge valve provided in the purge line to adjust flow rate of the purge gas. The fuel injection controller corrects an amount of fuel injected from an fuel injection valve based on an amount of fuel vapor contained in the purge gas flowing into a combustion chamber of the engine. The fuel injection controller comprises an estimation section for estimating the inflow amount of the purge gas flowing into the combustion chamber based on a passed amount of purge gas that has passed through the purge valve and a compensation value for compensating transportation delay. The compensation value is set based on internal pressure of the intake passage and velocity of intake air that flows into the combustion chamber.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF PREFERRED EMBODIMENTS

Figure 1:
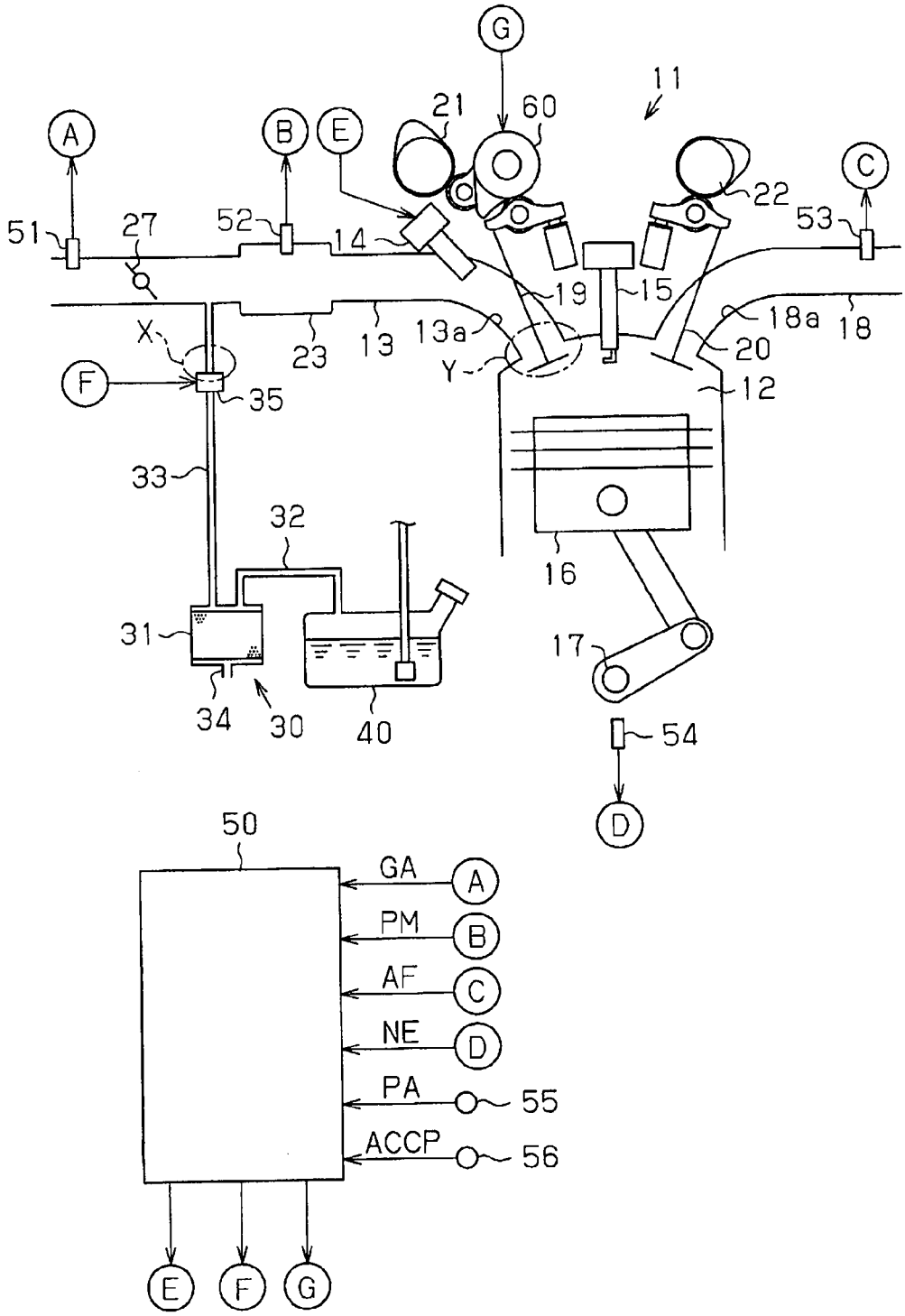
FIG. 1 is a schematic diagram of an internal combustion engine to which an embodiment of a fuel injection controller for the engine according to the invention is applied.
Figure 2:
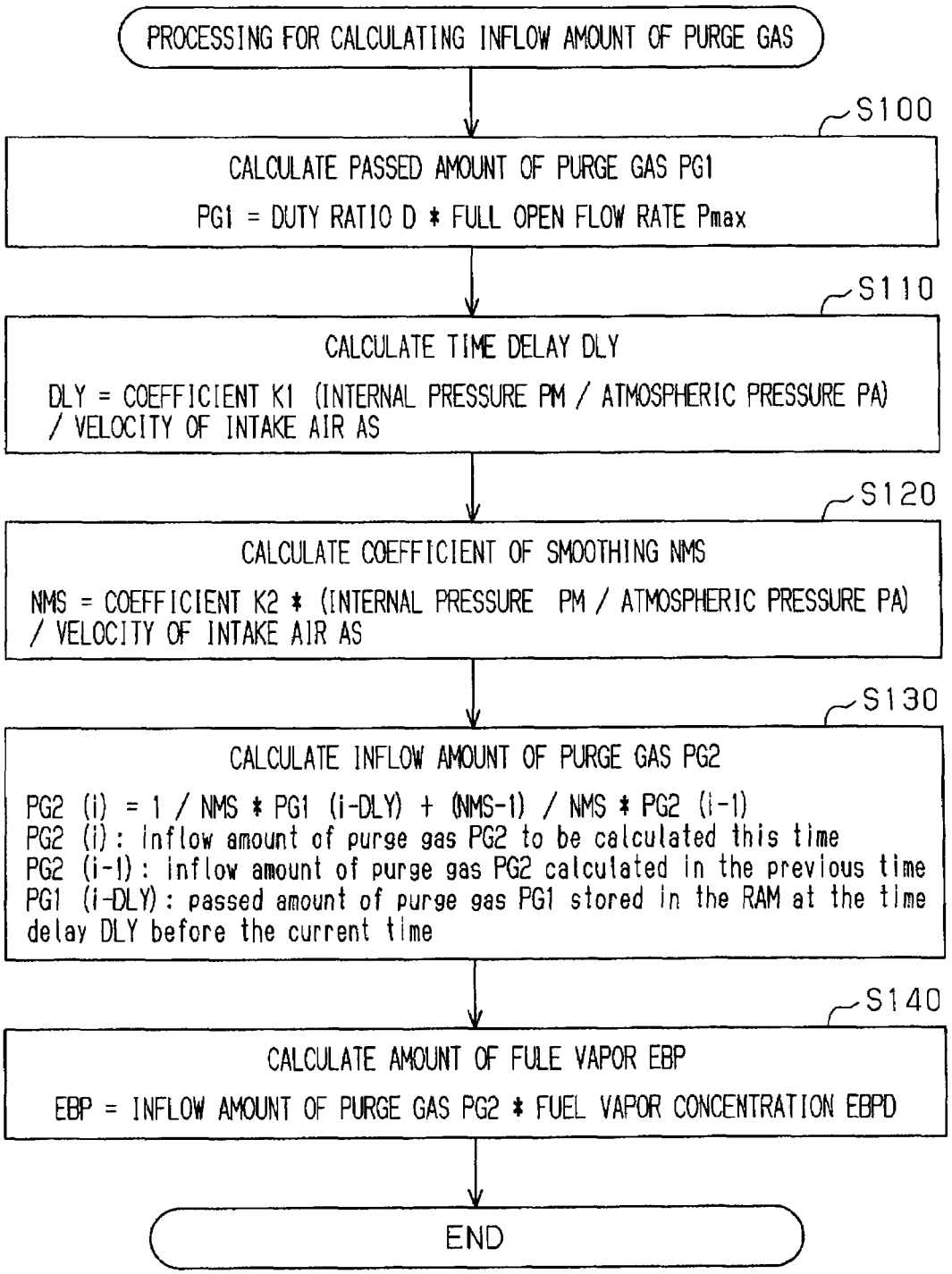
FIG. 2 is a flowchart illustrating processing for calculating inflow amount of purge gas.

Referring to FIGS. 1 and 2, a preferred embodiment of a fuel injection controller for an internal combustion engine according to the invention is described.

FIG. 1 illustrates an overview of an engine 11 to which the fuel injection controller of the preferred embodiment is applied.

As illustrated in FIG. 1, air is intaken to the combustion chamber 12 of the engine 11 via an intake passage 13 and an intake port 13*a*. A fuel injection valve 14 provided in the intake passage 13 injects an amount of fuel that accords with the amount of intake air. The air-fuel mixture formed from the fuel and air is ignited by an ignition plug 15, whereby the air-fuel mixture combusts and causes a piston 16 to move reciprocally. As a result, an engine output shaft, namely, a crank shaft 17, is rotated. Following combustion, the air-fuel mixture is discharged as exhaust gas from the combustion chamber 12 to an exhaust passage 18 via an exhaust port 18*a*.

A surge tank 23 is provided in the intake passage 13. A throttle valve 27 for adjusting the amount of intake air is provided in the intake passage 13 on the upstream of the surge tank 23.

An intake valve 19 is opened and closed to enable communication and separation of the intake port 13*a* and the combustion chamber 12. An exhaust valve 20 is opened and closed to enable communication and separation of an exhaust port 18*a* and the combustion chamber 12. Rotation of the crank shaft 17 is transmitted to an intake cam shaft 21 and an exhaust cam shaft 22. The intake valve 19 and the exhaust valve 20 are driven to open and close along with rotation of an intake cam shaft 21 and an exhaust cam shaft 22.

A variable lift device 60 is provided between the intake cam shaft 21 and the intake valve 19. This variable valve mechanism 31 varies a maximum lift amount of the intake valve 19. In the engine 11, the amount of intake air is controlled basically by varying the maximum lift amount. During this period, the throttle valve 27 is kept nearly full open.

A fuel vapor treatment device 30 is also provided in the engine 11. The fuel vapor treatment device 30 includes a vapor line 32 connected to a fuel tank 40, collector, or canister 31, connected to the vapor line 32, a purge line 33 provided in the intake passage 13 to connect the downstream side of the throttle valve 27 and the canister 31, and air introduction line 34 to introduce air into the canister 31. A purge valve 35 is also provided in the purge line 33. An opening degree of the purge valve 35 is adjusted by duty control. In specifically, when the duty ratio D in the drive signal of the purge valve 35 is 0%, the purge valve 35 is closed. As the duty ratio D becomes greater, the opening degree of the purge valve 35 increases. When the duty ratio D is 100%, the purge valve 35 is full open.

Fuel vapor generating in the fuel tank 40 is introduced from the fuel tank 40 through the vapor line 32 into the canister 31 and absorbed by an absorbent provided in the canister 31. Then, by opening the purge valve 35 to introduce air into the canister 31 via the air introduction line 34, the fuel vapor absorbed in the canister 31 is released. Purge gas, which is a mixture of the released fuel vapor and air, is fed into the intake passage 13 via the purge line 33. The fuel vapor contained in this purge gas combusts in the combustion chamber 12 together with fuel injected from the fuel injection valve 14. This purging process enables collecting performance of the canister 31 for collecting the fuel vapor to recover.

Various sensors for detecting an operating state of the engine 11 are also provided in the engine 11. For example, an air flow meter or intake air amount sensor 51 provided upstream of the throttle valve 27 detects an amount of intake air GA. A pressure sensor 52 provided in the surge tank 23 detects internal pressure PM of the intake passage 13. An air-fuel ratio sensor 53 provided in the exhaust passage 18 detects the concentration of oxygen in the exhaust gas. A crank angle sensor 54 provided near the crankshaft 17 detects the engine rotation speed NE. An atmospheric pressure sensor 55 detects atmospheric pressure PA. An accelerator sensor 56 detects a depression amount of an accelerator pedal (accelerator operation amount ACCP).

Various controls of the engine 11 are performed at a control unit or a controller 50. The controller 50 includes a microcomputer and receives the detection signals from each sensor as described above. Based on these signals, a central processing unit (CPU) of the controller carry out an operation in accordance with a control program, initial data or a control map stored in a read-only memory to perform various controls based on the result of the operation. For example, the controller 50 perform ignition timing control of the ignition plug 15, fuel injection control of the fuel injection valve 14, opening degree control of the throttle valve 27 and driving control of the variable lift device 60 based on the accelerator operation amount ACCP.

For the fuel injection control, so called air-fuel ratio control is performed. That is, a fuel injection amount from the fuel injection valve 14 is feedback controlled based on the concentration of oxygen detected by the air-fuel ratio sensor 53. As described above, when the purging process is conducted, fuel vapor contained in purge gas is also fed into the combustion chamber 12 separate from the fuel injected from the fuel injection valve 14. Thus, during the purging process, fuel injection control is conducted to reduce the fuel injection amount depending on the amount of fuel vapor contained in the purge gas so that the fluctuation in the air-fuel ratio is reduced or prevented as much as possible.

The controller 50 also performs control relating to the purging process, e.g., the opening degree control of the purge valve 35. As described above, until the amount of purge gas corresponding to the opening degree of the purge valve flows into the combustion chamber 12, there occur delay time and transportation delay of purge gas depending on the degree of change. Therefore, in order to reduce the fuel injection amount depending on the amount of the fuel vapor contained in the purge gas, such transportation delay of purge gas must be taken into consideration to estimate the amount of purge gas flowing into the combustion chamber 12.

The transportation delay of purge gas flowing into the combustion chamber 12 may be estimated based on the amount of air in the intake passage 13 and a shift amount of air in the intake passage 13 that may be calculated at the velocity of intake air flowing into the combustion chamber 12. As the amount of air in the intake passage 13 increases, the transportation delay becomes longer. As the velocity of intake air flowing into the combustion chamber 12 is larger, transportation delay becomes shorter.

The amount of air in the intake passage 13 becomes greater as the internal pressure PM of the intake passage 13 is higher. However, in such case, i.e., in the case when the internal pressure PM and the increase in the velocity of intake air are positively correlated, increase in the transportation delay due to the increase in the amount of air and reduction in the transportation delay due to the increase in the velocity of intake air are offset each other. In such a case, the transportation delay of purge gas can be estimated based on the engine rotation speed NE, as described above. For example, since the velocity of intake air becomes faster as the internal pressure PM increases, a compensation value for compensating the transportation delay (i.e., a value for estimating the amount of purge gas flowing into the combustion chamber based on the amount of purge gas the has passed through the purge valve) may be set based on the engine rotation speed NE when the amount of intake air is adjusted by the throttle valve 27 provided in the intake passage 13.

In this engine 11, amount of intake air is adjusted by varying a maximum lift amount of the intake valve 19 and the opening degree of the throttle valve 27 is basically kept full open. Thus, the internal pressure PM is relatively higher than the case in which the amount of intake air is adjusted by the throttle valve 27. If the internal pressure PM is constant, the amount of air flowing into the combustion chamber 12 becomes less and the velocity of intake air becomes lower as the maximum lift amount becomes smaller. In this way, n the engine 11 where the amount of intake air is adjusted by varying a maximum lift amount, the internal pressure PM and the velocity of intake air are not positively correlated. Accordingly, accurate setting of the compensation value for compensating the transportation delay based on the engine rotation speed is difficult.

To address this, in the present embodiment, the amount of purge gas flowing into the combustion chamber 12 is estimated based on the passed amount of purge gas that has passed through the purge valve 35 and the compensation value for compensating the transportation delay, and the compensation value is set based on the internal pressure PM of the intake passage 13 correlated with the amount of air in the intake passage 13 and velocity of intake air flowing into the combustion chamber 12.

FIG. 2 illustrates procedure for calculating an amount of purge gas flowing into the combustion chamber 12 (i.e., the amount of purge gas at the portion indicated by "Y" in FIG. 1; referred to as "inflow amount of purge gas".) The procedure for calculating the inflow amount of purge gas is performed repeatedly by the controller 50 during the purging process. This procedure constitutes an estimation section.

When the procedure starts, the amount PG1 of purge gas that has passed through the purge valve 35 (the amount of purge as at the portion indicated by "X" in FIG. 1; referred to as "passed amount of purge gas") is calculated based on the following Formula (1) (in step S100).

$$\text{Passed amount of purge gas } PG1 = \text{Duty ratio } D^* \text{Flow rate at full open } P\text{max} \quad (1)$$

Flow rate at full open Pmax is flow rate of purge gas when the purge valve 35 is full open and the value of Pmax is variable to be greater as the internal pressure PM decreases. The flow rate Pmax multiplied by the duty ratio D, which reflects the opening degree of the purge valve 35, equals the passed amount of purge gas PG1. The duty ratio D is set to a value corresponding to a target purge flow rate determined based on the engine rotation speed or the amount of intake air. Every time the passed amount of purge gas PG1 is calculated, the resultant value is stored in the RAM of the controller 50. That is, one or more passed amounts of purge gas PG1 are stored in the RAM over time.

Next, delay time DLY until the purge gas that has passed through the purge valve 35 reaches the combustion chamber 12, which is the compensation value for compensating transportation delay, is calculated based on the following Formula (2) (in step S110).

$$\text{Delay time } DLY = \text{Coefficient } K1^* (\text{Internal pressure } PM / \text{Atmospheric pressure } PA) / \text{velocity of intake air } AS \quad (2)$$

The delay time becomes longer as the volume of the line through which purge gas passes is greater. The coefficient K1 is set to an appropriate value based on the total internal volume of the related elements such as the purge line 33, the intake passage 13, the surge tank 23, and the intake port 13*a* of the engine 11. The velocity of intake air AS is detected based on the amount of intake air GA by the intake air amount sensor 51.

As described above, as the amount of air in the intake passage 13 is greater, the transportation delay of purge gas flowing into the combustion chamber 12 becomes longer. As the velocity of intake air AS flowing into the combustion chamber 12 is larger, the transportation delay becomes shorter. Thus, in the Formula (2), the delay time DLY is set to be greater as the internal pressure PM is higher and the amount of air in the intake passage 13 is greater while the delay time DLY is set to be smaller as the velocity of intake air AS is higher. In this way, the delay time DLY, which is the compensation value for compensating transportation delay, is set accurately.

Next, in the present embodiment, inflow amount of purge gas PG2 is calculated in a smoothing process. The coefficient of smoothing NMS used in the smoothing process is calculated by the following Formula (3) (in step S120).

$$\text{Coefficient of smoothing } NMS = \text{Coefficient } K2^* (\text{internal pressure } PM / \text{Atmospheric pressure } PA) / \text{Velocity of intake air } AS \quad (3)$$

Figure 4:
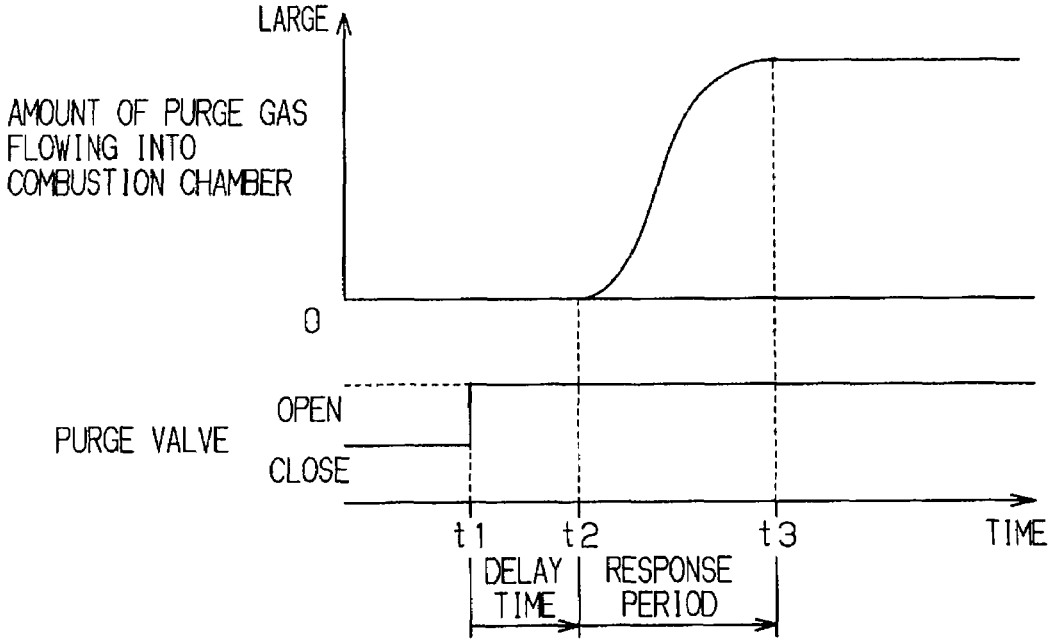
FIG. 4 is a timing chart illustrating delay in transporting purge gas.

As described with reference to FIG. 4, after the purge gas starts flowing into combustion chamber 12 at time t2, inflow amount of purge gas PG 2 is gradually changed at a certain degree of change. Then, after some degree of response period goes by, the inflow amount PG2 reaches an amount corresponding to the opening degree of the purge valve 35 at time t3. The inflow amount of purge gas PG 2 in such a response period may be estimated by performing the smoothing process on the passed amount of purge gas PG1. In operating such a smoothing process, the coefficient of smoothing used in such a smoothing process corresponds to the degree of change. As mentioned above, the degree of change while the inflow amount of purge gas PG2 gradually changes becomes smaller as the volume through which purge gas passes is greater. Thus, the coefficient K2 is set to an appropriate value based on the total internal volume of the related elements such as the purge line 33, the intake passage 13, the surge tank 23, and the intake port 13*a* of the engine 11.

In addition, as described above, as the amount of air in the intake passage 13 is greater, the transportation delay of purge gas flowing into the combustion chamber 12 becomes longer. As the velocity of intake air AS flowing into the combustion chamber 12 is larger, the transportation delay becomes shorter. In more specifically, in the response period, the degree of change while the inflow amount of purge gas PG2 gradually changes becomes smaller as the amount of air in the intake passage 13 is greater whereas the degree of change becomes larger as the velocity of intake air AS is larger. Thus, in the Formula (3), the coefficient of smoothing NMS is set to be greater as the amount of air in the intake passage 13 is greater. Since the coefficient of smoothing NMS is set to be greater as the internal pressure PM is higher, the degree of change in the inflow amount of purge gas PG2 calculated in the smoothing process is reduced. On the other hand, the coefficient of smoothing NMS is set to be smaller as the velocity of intake air AS is higher. This configuration causes the degree of change in the inflow amount of purge gas PG2 calculated in the smoothing process to increase.

By accurately setting the coefficient of smoothing NMS, which is used for the smoothing process and is the compensation value for compensating transportation delay, based on the internal pressure PM and the velocity of intake air AS, the inflow amount of purge gas PG2 that gradually changes in the response period can be also estimated accurately.

Next, the inflow amount of purge gas PG2 is calculated in the smoothing process (in step S130). The inflow amount of purge gas PG2 is calculated as follows. The purge gas that has passed through the purge valve 35 flows into the combustion chamber 12 after the delay time DLY. Thus, in order to calculate the inflow amount of purge gas PG2 flowing into the combustion chamber 12 in the smoothing process, the smoothing process is performed on the passed amount of purge gas PG1, which is the amount at the time delay time DLY before the calculation timing of the inflow amount of purge gas PG2, whereby the accuracy in estimating the inflow amount of purge gas PG2 at that calculation timing is improved. Thus, in step S130, the inflow amount of purge gas PG2 is calculated based on the primary expression of the smoothing represented by the Formula (4):

$$\text{Inflow amount of purge gas } PG2(i)=1/NMS*PG1(i-DLY)+(NMS-1)/NMS*PG2(i-1) \quad (4)$$

wherein PG2 (i) is an inflow amount of purge gas PG2 to be calculated this time, DLY is the delay time calculated in step S110, NMS is the coefficient of smoothing calculated in step S120, PG1 (i−DLY) is a passed amount of purge gas PG1 stored in the RAM at the delay time DLY before the current time, and PG2 (i−1) is the inflow amount of purge gas PG2 calculated in the previous time.

As represented by Formula (4), at the timing to calculate the inflow amount of purge gas PG2, the inflow amount of purge gas PG2 at the current timing is calculated by performing the smoothing process on the passed amount of purge gas PG1 that was stored the delay time DLY before the current timing using coefficient of smoothing NMS, whereby the estimation accuracy is improved.

After the inflow amount of purge gas PG2 is calculated, then the amount of fuel vapor EBP contained in the purge gas flowing into the combustion chamber 12 is calculated based on the following Formula (5) (in step S140).

$$\text{Fuel vapor amount } EBP=\text{Inflow amount of purge gas } PG2*\text{Fuel vapor concentration } EBPD \quad (5)$$

The concentration of fuel vapor is concentration of fuel vapor in the purge gas and calculated as follow.

When the purge gas is introduced in the intake passage 13, the air-fuel ratio shifts to the rich side. This causes a feedback control value of the fuel injection amount set in the air-fuel ratio control during the purging process to be greater in a direction to reduce the fuel injection amount. In addition, the higher the concentration of fuel vapor in the purge gas is, the greater the feedback correction value becomes in a direction to reduce the fuel injection amount. In the present embodiment, the fuel vapor concentration EBPD is calculated based on the feedback correction value. Alternatively or additionally, the fuel vapor concentration EBPD may be calculated based on the change in the air-fuel ratio when the purge valve 35 is opened or the fuel vapor concentration EBPD may be directly detected by the sensor provided in the purge line 33 for detecting the concentration of fuel vapor.

The estimation accuracy of the fuel vapor amount EBP calculated in step S140 is high enough since the estimation accuracy of the inflow amount of purge gas PG2 calculated in step S130 is sufficiently high. After the fuel vapor amount EBP is calculated, the procedure ends.

Thereafter, the correction of the basic fuel injection amount, which is set based on the operating state of the engine, is made. In the correction, the fuel vapor amount EBP is subtracted from the basic fuel injection amount. Since estimation accuracy of the fuel vapor amount EBP is sufficiently high, in this correction of the basic fuel injection amount, the fuel injection amount during the purging process can be reduced accurately.

Further, the inflow amount of purge gas PG2 is added to the amount of intake air GA detected by the intake air amount sensor 51 to calculate a total amount of intake air flowing into the combustion chamber 12. Again, in this calculation, since estimation accuracy of the inflow amount of purge gas PG2 is sufficiently high, estimation accuracy of the total amount of intake air flowing into the combustion chamber 12 becomes sufficiently high.

The present embodiment has the following advantages.

(1) In the engine 11 having a variable lift device 60 for changing a maximum lift of the air intake valve 19 and adjusting the amount of intake air based on the change in the maximum lift, the internal pressure PM of the intake passage 13 and the velocity of intake air AS flowing into the combustion chamber 12 are not positively correlated. In such an engine 11, a compensation value for compensating the transportation delay is set based on the internal pressure PM, which is correlated with the amount of air in the intake passage 13, and the velocity of intake air AS. Then, the inflow amount of purge gas PG2 flowing into combustion chamber 12 is estimated based on the compensation value and the passed amount of purge gas PG1 that has passed through the purge valve 35. Since the compensation value for compensating the transportation delay is set based on suitable parameters related to the transportation delay in purge gas flowing in to the combustion chamber 12, the compensation value can be set accurately and estimation accuracy of the inflow amount of purge gas PG2 is improved. Accordingly, even in the engine 11 in which the internal pressure PM and the velocity of intake air AS are not positively correlated, the amount of purge gas flowing into the combustion chamber 12 can be estimated accurately.

(2) The delay time DLY until the purge gas that has passed through the purge valve 35 reaches the combustion chamber 12, which is the compensation value for compensating transportation delay, is calculated based on the internal pressure PM and the velocity of intake air AS. Accordingly, the delay time DLY can be set accurately.

(3) The inflow amount of purge gas PG2 is calculated by performing the smoothing process on the passed amount of purge gas PG1. Then, the coefficient of smoothing NMS, which is used for the smoothing process and is the compensation value for compensating transportation delay, is set based on the internal pressure PM and the velocity of intake air AS. Accordingly, the coefficient of smoothing NMS can be set accurately and the inflow amount of purge gas PG2 that is gradually changed during the response period can be estimated accurately.

(4) The passed amounts of purge gas PG1 are stored in the RAM over time. Then, at the timing to calculate the inflow amount of purge gas PG2, a smoothing process is performed on the passed amount of purge gas PG1 that was stored at the delay time DLY before the calculation timing using the coefficient of smoothing NMS. Accordingly, estimation accuracy of the inflow amount of purge gas PG2 is improved.

The above embodiment may be modified as follows.

Figure 3:
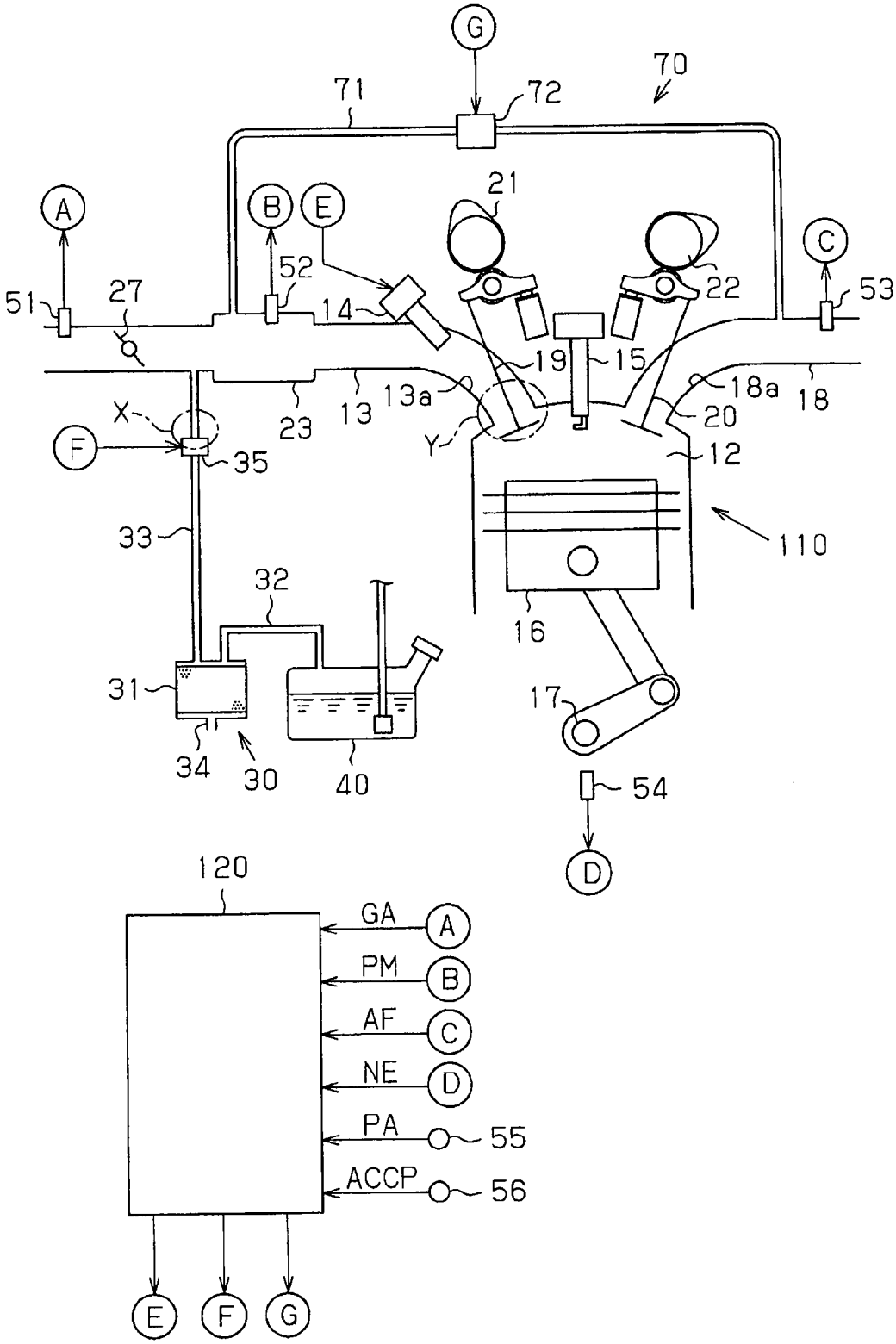
FIG. 3 is a schematic diagram of an internal combustion engine to which a modified version of the embodiment of FIG. 1 is applied.

In the above embodiment, a fuel injection controller according to the invention is applied to the engine 11 including a variable lift device 60. However, as illustrated in FIG. 3 instead, a fuel injection controller according to the invention may be applied to the engine 110 in which the variable lift device 60 is not equipped, the air intake amount is adjusted by the control of opening degree of the throttle valve 27, and an exhaust gas recirculation mechanism 70 for introducing exhaust gas into the intake passage 13. The same effects as described above can be obtained in this embodiment.

Referring to FIG. 3, the exhaust gas recirculation mechanism 70 includes a recirculation passage 71 for connecting the surge tank 23 in the intake passage 13 and the exhaust passage 18 and an EGR valve 72 provided in the recirculation passage 71 for adjusting the introduction amount of exhaust gas. In the engine 110 having the exhaust gas recirculation mechanism 70, various controls as the controller 50 performs are done by a controller 120 and opening degree control of the EGR valve 72 and opening degree control of the throttle valve 27 for adjusting the amount of intake air are performed.

In the engine 110 having the exhaust gas recirculation mechanism 70, when exhaust gas is introduced into intake passage 13, it is likely that the internal pressure PM in the intake passage 13 becomes high but the velocity of intake air AS does not change so much. That is, in such an engine 110, the internal pressure PM and the velocity of intake air AS are positively correlated each other when the exhaust gas is not introduced into the intake passage 13 whereas the internal pressure PM and the velocity of intake air AS are not positively correlated when the exhaust gas is introduced into the intake passage 13. To address this, the calculation of the inflow amount of purge gas as described above is performed in the controller 120 so that the inflow amount of purge gas PG2 can be estimated accurately in the engine 110 where it sometimes happens that inflow amount of purge gas PG2 each other. The present invention may be also applied to an internal combustion engine including a variable lift device 60 and an exhaust gas recirculation mechanism 70.

The calculation of the inflow amount of purge gas is based on the principle that the transportation delay of the purge gas flowing into the combustion chamber 12 is estimated based on the amount of air in the intake passage 13 and the velocity of intake air flowing into the combustion chamber 12. This principle can be applied to the engine in which the internal pressure PM and the velocity of intake air AS are positively correlated. Therefore, although the internal pressure PM and the velocity of intake air AS are not positively correlated in the engine in the first embodiment and the embodiment as illustrated in FIG. 4, the controller of the present invention may be also applied to the internal combustion engine in which the internal pressure PM and the velocity of intake air AS are positively correlated.

Instead of calculating both the delay time DLY and the coefficient of smoothing NMS based on the internal pressure PM and the velocity of intake air AS, either one of them may be calculated.

In stead of detecting the internal pressure PM by the pressure sensor 52, the internal pressure PM may be estimated using an appropriate physics model.

The above fuel injection controller for the internal combustion engine may be applied not only to a gasoline engine including an ignition plug but also a diesel engine.

What is claimed is:

1. A fuel injection controller for an internal combustion engine, wherein the engine includes a fuel vapor treatment device having a collector for collecting fuel vapor generating in a fuel tank; a purge line that introduces purge gas into an intake passage of the engine, the purge gas being a mixture of fuel vapor released from the collector and air; and a purge valve provided in the purge line to adjust flow rate of the purge gas; wherein the fuel injection controller corrects an amount of fuel injected from an fuel injection valve based on an amount of fuel vapor contained in the purge gas flowing into a combustion chamber of the engine, the fuel injection controller comprising:

an estimation section for estimating the inflow amount of the purge gas flowing into the combustion chamber based on a passed amount of purge gas that has passed through the purge valve and a compensation value for compensating transportation delay, wherein the compensation value is set based on internal pressure of the intake passage and velocity of intake air that flows into the combustion chamber.

2. The fuel injection controller of claim 1, wherein the compensation value for compensating transportation delay includes delay time until the purge gas that has passed through the purge valve reaches the combustion chamber.

3. The fuel injection controller of claim 1, wherein the compensation value for compensating transportation delay includes a coefficient of smoothing used for a smoothing process, wherein the estimation section calculates the inflow amount of the purge gas by performing the smoothing process on the passed amount of purge gas that has passed through the purge valve.

4. The fuel injection controller of claim 1, wherein the compensation value for compensating transportation delay includes delay time until the purge gas that has passed through the purge valve reaches the combustion chamber and a coefficient of smoothing used for a smoothing process, wherein the estimation section stores one or more passed amounts of purge gas over time, wherein, at calculation timing, the estimation section calculates the inflow of the purge gas by performing the smoothing process on the amount of purge gas stored the delay time before the calculation timing using the coefficient of smoothing.

5. The fuel injection controller of claim 1, wherein the engine includes a variable lift device for changing a maximum lift of the air intake valve, wherein an amount of intake air is adjusted by the variation of the maximum lift.

6. The fuel injection controller of claim 1, wherein the engine includes an exhaust gas recirculation mechanism into the intake passage.

* * * * *